US005447043A

United States Patent [19]

Hwang

[11] Patent Number: 5,447,043

[45] Date of Patent: Sep. 5, 1995

[54] LOCK ASSEMBLY WITH FLEXIBLE SHACKLE

[76] Inventor: Meei-Lih Hwang, No. 350, Chung-Shan Rd., Fang-Liao Hsiang, Ping-Tung Hsien, Taiwan

[21] Appl. No.: 201,320

[22] Filed: Feb. 24, 1994

[51] Int. Cl.[6] ..... E05B 67/06

[52] U.S. Cl. ..... 70/49; 70/386

[58] Field of Search ..... 70/14, 15, 18, 30, 49, 70/386, DIG. 36, 233, 53

[56] References Cited

U.S. PATENT DOCUMENTS

| | | | |
|---|---|---|---|
| 4,075,878 | 2/1978 | Best | 70/49 |
| 4,819,464 | 4/1989 | Kuo | 70/18 |
| 4,831,849 | 5/1989 | Kortenbrede | 40/417 |
| 4,998,422 | 3/1991 | Borgmann et al. | 70/38 A |
| 5,009,087 | 4/1991 | Long | 70/49 |
| 5,170,650 | 12/1992 | Kortenbrede | 70/49 |
| 5,291,765 | 3/1994 | Hoisington | 70/233 |

FOREIGN PATENT DOCUMENTS

| | | | |
|---|---|---|---|
| 0476318 | 3/1992 | European Pat. Off. | 70/49 |
| 1596781 | 8/1981 | United Kingdom | 70/49 |
| 2240578 | 8/1991 | United Kingdom | 70/49 |

*Primary Examiner*—Peter M. Cuomo
*Assistant Examiner*—Darnell M. Boucher
*Attorney, Agent, or Firm*—Sandler, Greenblum & Bernstein

[57] ABSTRACT

A lock assembly includes a lock shell formed with a ball-receiving channel which receives a movable locking ball therein and which intercommunicates longitudinally extending and transversely extending holes that are formed in the shell. A flexible shackle is connected to the shell at a first end portion and is provided with a retaining member at a second end portion. The retaining member is insertable into the transversely extending hole and has a peripheral surface formed with an annular groove. A push member is disposed slidably in the transversely extending hole and is biased to slide outwardly of the transversely extending hole. A key plug is received rotatably in the longitudinally extending hole and has an inner end portion provided with a ball-receiving notch. The plug is rotatable between a locking position, wherein the retaining member is inserted into the transversely extending hole and the notch is misaligned with the channel so as to permit extension of the ball into the transversely extending hole to engage the groove of the retaining member in order to retain the retaining member in the transversely extending hole, and an unlocking position, wherein the notch is aligned with the channel and the push member is biased outwardly so as to urge the ball to disengage the groove of the retaining member and engage the notch.

4 Claims, 5 Drawing Sheets

LOCK ASSEMBLY WITH FLEXIBLE SHACKLE

BACKGROUND OF THE INVENTION

1. Field of The Invention

This invention relates to a lock assembly with a flexible shackle, more particularly to a lock assembly which is easy to manufacture and assemble and which is convenient to use.

2. Description of the Related Art

FIGS. 1 and 2 show a conventional lock assembly which has a flexible shackle and which is typically used for a bicycle. The conventional lock assembly generally includes a lock shell 10, a key plug 11, flexible shackle 17 (shown in part), a locking ball 13 and a covering plate 14. The lock shell 10 has a generally annular peripheral surface formed with a first radial hole 101 and a second radial hole 102 which extends in a direction that is generally perpendicular to the first radial hole 101. The lock shell 10 further has an end surface which is formed with a plurality of aligned tumbler-receiving holes 103 and a ball-receiving channel 104 that is accessible via the end surface and that intercommunicates the first and second radial holes 101,102. The key plug 11 is disposed rotatably in the first radial hole 101 and is formed with a ball-receiving notch 112 in the peripheral surface of an inner end portion of the key plug 11. After a plurality of tumbler segments 15 and tumbler springs 16 have been disposed respectively in a corresponding one of the tumbler-receiving holes 103 and a locking ball 13 is received in the ball-receiving channel 104, the covering plate 14 is mounted on the lock shell 10 so as to cover the end surface in order to retain the tumbler segments 15 and the tumbler springs 16 in the tumbler-receiving holes 103. The flexible shackle 17 has a first end connected to the lock shell 10 and a second end having a retaining member 12 connected thereto. The retaining member 12 is insertable into the second radial hole 102 and is generally a cylindrical rod which has a peripheral surface that is formed with an annular groove 121.

When an appropriate key 18 is inserted into a keyway formed in the key plug 11, the key plug 11 is rotatable between a locking position, wherein the retaining member 12 of the flexible shackle 17 is inserted into the second radial hole 102 and the ball-receiving notch 112 of the key plug 11 is misaligned with the locking ball 13 so as to permit extension of the locking ball 13 into the second radial hole 102 to engage the annular groove 121 of the retaining member 12 in order to retain the retaining member 12 in the second radial hole 102, and an unlocking position, wherein the ball-receiving notch 112 is aligned with the locking ball 13 and the retaining member 12 can be pulled to move outwardly so as to urge the locking ball 13 to disengage the annular groove 121 of the retaining member 121 and engage the ball-receiving notch 112 in order to permit extraction of the retaining member 12 from the second radial hole 102.

The aforementioned conventional lock assembly has the following drawbacks:

(1) Referring again to FIG. 2, since the aforementioned conventional lock assembly employs a tumblers-type key plug 11, the lock shell 10 must be formed with a plurality of tumbler-receiving holes 103 for disposing the tumbler segments 15 and the tumbler springs 16 therein and must be provided with a covering plate 14 for retaining the tumbler segments 15 and the tumbler springs 16 in the tumbler-receiving holes 103. Forming the tumbler-receiving holes 103 and assembling the tumbler segments 15 and the tumbler springs 16 in the tumbler-receiving holes 103 increase the complexity of the manufacturing process, thereby resulting in a longer production time and in an increased production cost.

(2) Referring to FIG. 2, the connection between the first end of the flexible shackle 17 and the lock shell 10 is achieved by an additional process, thereby inconveniencing the manufacture thereof.

(3) To unlock the aforementioned conventional lock assembly, one of the user's hands holds the lock shell 10, while the other one of the user's hands rotates the key plug 11 from the locking position to the unlocking position with the use of the appropriate key 18. However, since the retaining member 12 cannot be ejected automatically from the second radial hole 102 of the lock shell 10 after the key plug 11 has been rotated to the unlocking position, the retaining member 12 must be extracted with the use of one of the user's hands. It is inconvenient for the user to hold the lock shell 10 and rotate the key plug 11 to the unlocking position at the same time with the use of one hand, while the flexible shackle 17 is pulled to permit extraction of the retaining member 12 with the use of the other hand. Accordingly, the same problem is encountered when inserting and retaining the retaining member 12 in the second radial hole 102. That is, the user must hold the lock shell 10 and rotate the key plug 11 at the same time with the use of one hand, while the retaining member 12 is inserted into the second radial hole 102 with the use of the other hand.

SUMMARY OF THE INVENTION

Therefore, the main object of the present invention is to provide a lock assembly which is easy to manufacture and assemble.

Another object of the present invention is to provide a lock assembly which is convenient to use.

According to the present invention, a lock assembly includes a lock shell, a flexible shackle, a pushing assembly, a movable locking ball and a key plug. The lock shell is formed with a longitudinally extending hole, a transversely extending hole adjacent one end of the longitudinally extending hole, and a longitudinal ball-receiving channel which is adjacent to the longitudinally extending hole and which intercommunicates the longitudinally extending hole and the transversely extending hole. The flexible shackle has a first end portion which is connected to the look shell and a second end portion which is provided with a retaining member. The retaining member is insertable into the transversely extending hole of the lock shell and has a peripheral surface formed with an annular groove. The pushing assembly includes a push member that is disposed slidably in the transversely extending hole of the lock shell, and a biasing unit which biases the push member to slide outwardly of the transversely extending hole. The movable looking ball is received in the ball-receiving channel. The key plug is received rotatably in the longitudinally extending hole of the lock shell and has an inner end portion with a peripheral surface that is formed with a ball-receiving notch. The key plug is rotatable between a locking position, wherein the retaining member of the shackle is inserted into the transversely extending hole to compress the biasing unit and the ball-receiving notch of the key plug is misaligned with the ball-receiving channel so as to permit extension of the locking ball into the transversely extending hole to engage the annular groove of the retaining member in order to retain the retaining member in the transversely extending hole, and an unlocking position, wherein the ball-receiving notch is aligned with the ball-receiving channel and the biasing unit biases the push member outwardly so as to cause corresponding outward movement of the retaining member in order to urge the looking ball to disengage the annular groove of the retaining member and engage the ball-receiving notch.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENT

Figure 1:
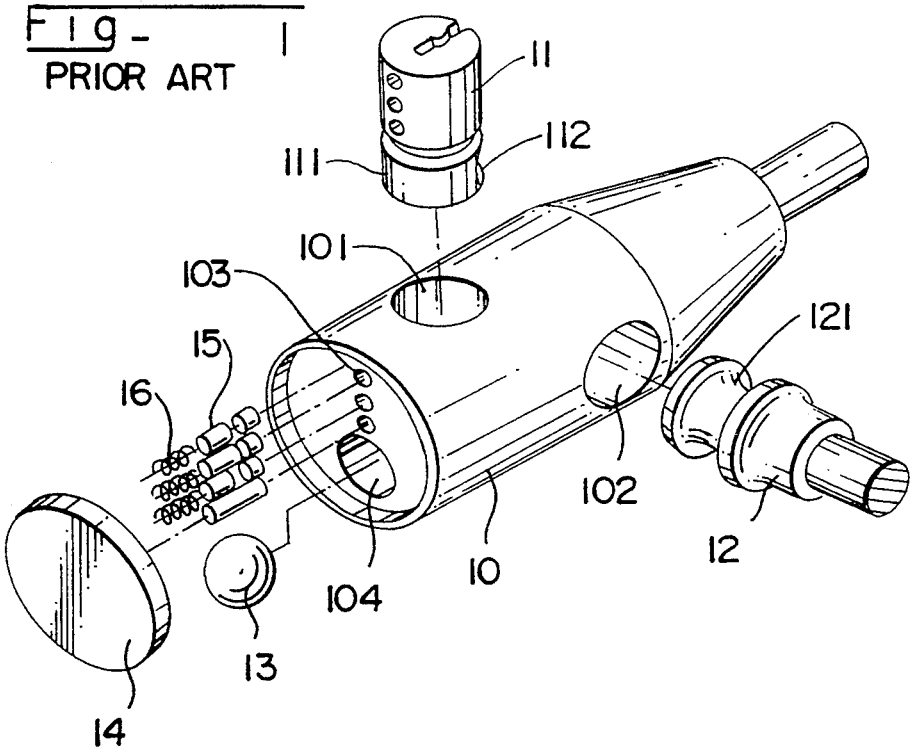
Fig- 1 PRIOR ART
FIG. 1 is a schematic exploded view illustrating a conventional, lock assembly which has a flexible shackle.
Figure 2:
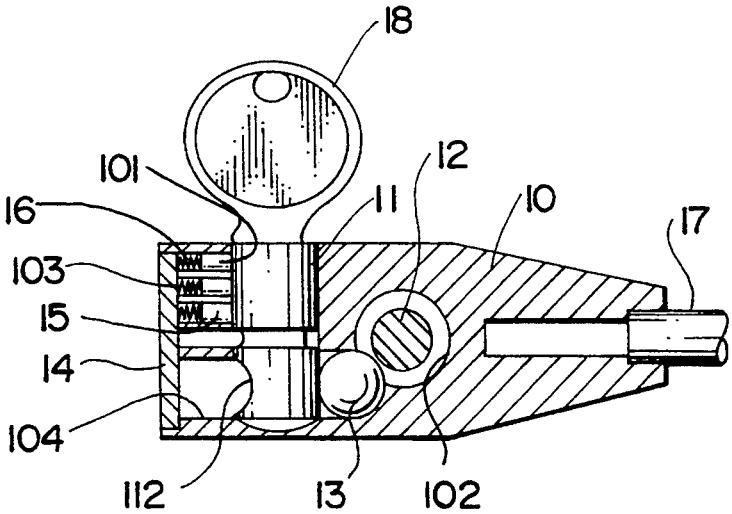
Fig- 2 PRIOR ART
FIG. 2 is a sectional view showing the conventional lock assembly of FIG. 1 when an appropriate key is inserted into a key way of a key plug of the conventional lock assembly.
Figure 3:
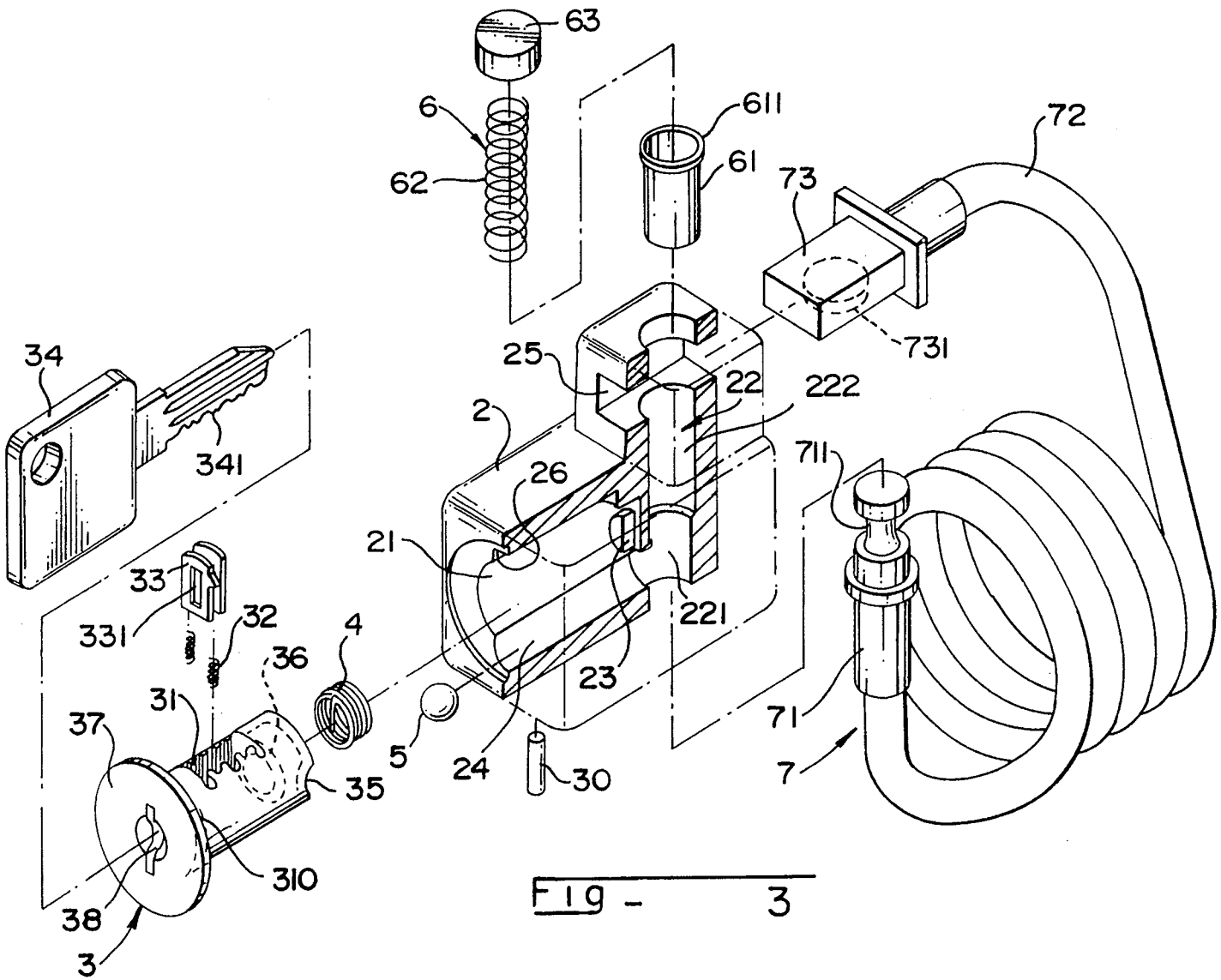
FIG. 3 is an exploded view showing a lock assembly with flexible shackle in accordance with a first embodiment of the present invention.
Figure 4:
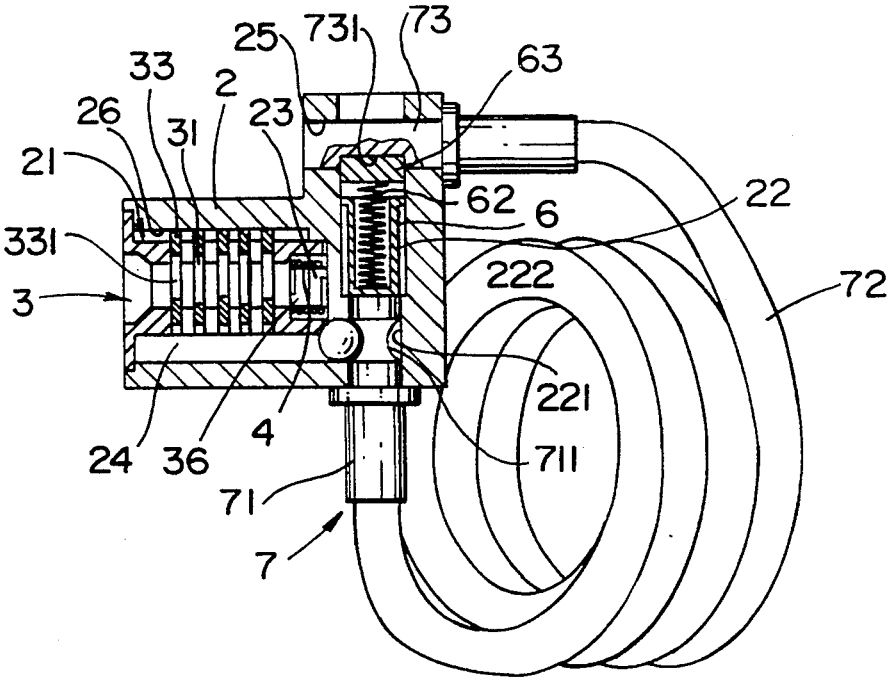
FIG. 4 is a schematic sectional view showing the lock assembly according to the first embodiment of the present invention, wherein a key plug of the lock assembly is in a locking position.

Referring to FIGS. 3 and 4, a lock assembly in accordance with a first embodiment of the present invention includes a lock shell 2, a key plug 3, a torsional spring unit 4, a movable locking ball 5, a pushing assembly 6 and a flexible shackle 7.

The lock shell 2 is formed with a longitudinally extending hole 21, a transversely extending hole 22 which is adjacent to one end of the longitudinally extending hole 21, and a longitudinal ball-receiving channel 24 which is adjacent to the longitudinally extending hole 21 and which intercommunicates the longitudinally extending hole 21 and the transversely extending hole 24. The lock shell 2 has an annular inner wall surface and an inner end wall which cooperatively define the longitudinally extending hole 21. The inner end wall of the lock shell 2 is formed with a positioning unit 23. The annular inner wall surface of the lock shell 2 is formed with a longitudinally extending locking groove 26. The transversely extending hole 22 has a large diameter portion 222 and a small diameter portion 221 which is located outwardly of the large diameter portion 222 and which is communicated with the ball-receiving channel 24. The look shell 2 is further formed with a receiving space 25 which is located above and communicated with the larger diameter portion 222 of the transversely extending hole 22.

The flexible shackle 7 includes a locking cable 7 which has a first end portion provided with an engaging member 73 and a second end portion provided with a retaining member 71. The retaining member 71 has a peripheral surface which is formed with an annular groove 711 and is insertable into the small diameter portion 221 of the transversely extending hole 22 of the lock shell 2. In the present embodiment, the engaging member 73 is rectangular in shape and has a bottom surface which is formed with an indentation 731. The engaging member 73 is sized so as to extend into the receiving space 25 in the lock shell 2.

The pushing assembly 6 includes a push member 61, a biasing means 62 and a positioning block 63. The push member 61 is disposed slidably in the transversely extending hole 22 of the lock shell 2 and is sized so as to be slidable between the large diameter portion 222 and the small diameter portion 221 of the transversely extending hole 22. The push member 61 has an annular flange 611 which extends radially outward from an upper end thereof and which is sized so as to prevent the push member 61 from disengaging the transversely extending hole 22 via the small diameter portion 221 of the latter. The positioning block 63 is disposed slidably in the large diameter portion 222 of the transversely extending hole 22 adjacent to the receiving space 25. In the present embodiment, the biasing means 62 is a spring unit and is disposed in the large diameter portion 222 of the transversely extending hole 22 between the push member 61 and the positioning block 63 so as to bias the push member 61 to slide outwardly of the vertically extending hole 22 via the small diameter portion 221 of the latter and so as to bias the positioning block 63 to extend into the receiving space 25 in order to engage the indentation 731 of the engaging member 73 of the flexible shackle 7, thereby retaining the engaging member 73 in the receiving space 25.

The movable locking ball 5 is received in the longitudinal ball-receiving channel 24 of the lock shell 2.

The torsional spring unit 4 is disposed in the longitudinally extending-hole 21 of the lock shell 2 between the inner end wall of the lock shell 2 and an inner end portion of the key plug 3. The torsional spring unit 4 has a first end that is connected to the positioning unit 23 of the lock shell 2, and a second end.

Referring now to FIGS. 3 to 7, the key plug 3 is formed with a key hole 28 and is received rotatably in the longitudinally extending hole 21 of the lock shell 2. An annular flange member 37 extends radially outward from an outer end of the key plug 3 so as to cover the longitudinally extending hole 21 and the ball-receiving channel 24. A plurality of aligned plate grooves 31 is formed transversely in the outer wall surface of the key plug 3. Each of the plate grooves 31 has a given depth and receives a corresponding locking plate 33 therein. Each of the locking plates 33 is formed with an axially aligned hole 331 so that the aligned holes 331 of the locking plates 33 cooperatively define a keyway. Each of the locking plates 33 is normally biased by a spring unit 32 disposed in each plate groove 31 to extend into the locking groove 26 of the lock shell 2 so as to prevent rotation of the key plug 3. A key 34, which has a plurality of key bits 341, is insertable into the keyway via the key hole 38. Each of the locking plates 33 is retracted into the corresponding plate groove 31 by a respective one of the-key bits 341 when the key 34 is inserted into the keyway via the key hole 38. At this stage, rotation of the key plug 3 is permitted. The key plug 3 further has an inner end portion which has a peripheral surface formed with a ball-receiving notch 35 and which has an end surface formed with an engaging groove 36 (see FIG. 6). The second end of the torsional spring unit 4 engages the engaging groove 36 of the key plug 3. An elongated locating groove 310 is formed transversely in the outer wall of the key plug 3. A retaining pin 30 extends through the lock shell 2 and into the locating groove 310 of the key plug 3 so as to retain the key plug 3 in the longitudinally extending hole 21 of the lock shell 2 and so as to limit rotation of the key plug 3 between a locking position (FIG. 4), wherein the retaining member 71 of the flexible shackle 7 is inserted into the small diameter portion 221 of the transversely extending hole 22 to compress the biasing means 62 and the ball-receiving notch 35 of the key plug 3 is misaligned with the ball-receiving channel 24 so as to permit extension of the locking ball 5 into the small diameter portion 221 of the transversely extending hole 22 to engage the annular groove 711 of the retaining member 71 in order to retain the retaining member 71 in the small diameter portion 221 of the transversely extending hole 22, and an unlocking position (FIG. 8), wherein the ball-receiving notch 35 is aligned with the ball-receiving channel 24 and the biasing means 62 biases the push member 61 outwardly so as to cause corresponding outward movement of the retaining member 71 in order to urge the locking ball 5 to disengage the annular groove 711 of the retaining member 71 and engage the ball-receiving notch 35.

Figure 7:
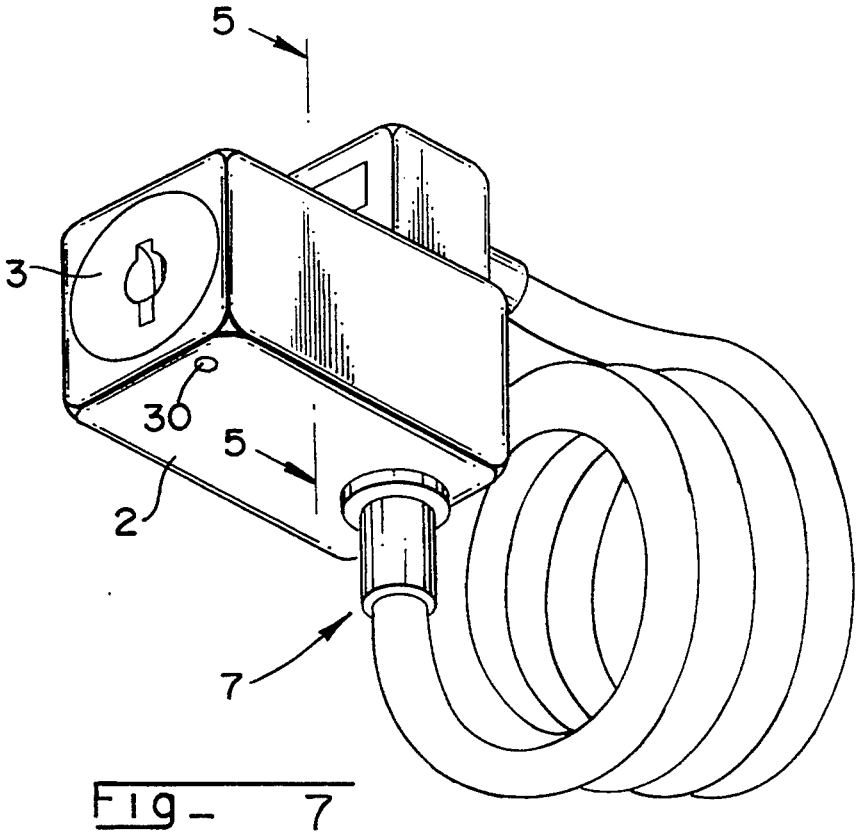
FIG. 7 is a perspective view illustrating the lock assembly according to the first embodiment of the present invention.
Figure 5:
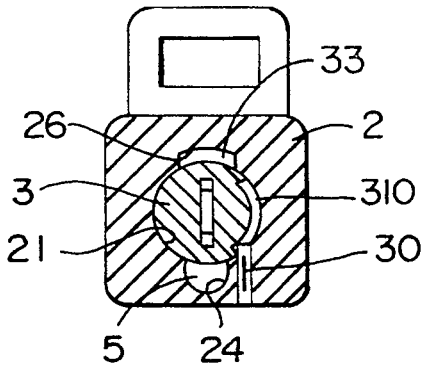
FIG. 5 is a another schematic sectional view showing the lock assembly according to the first embodiment of the present invention
Figure 8:
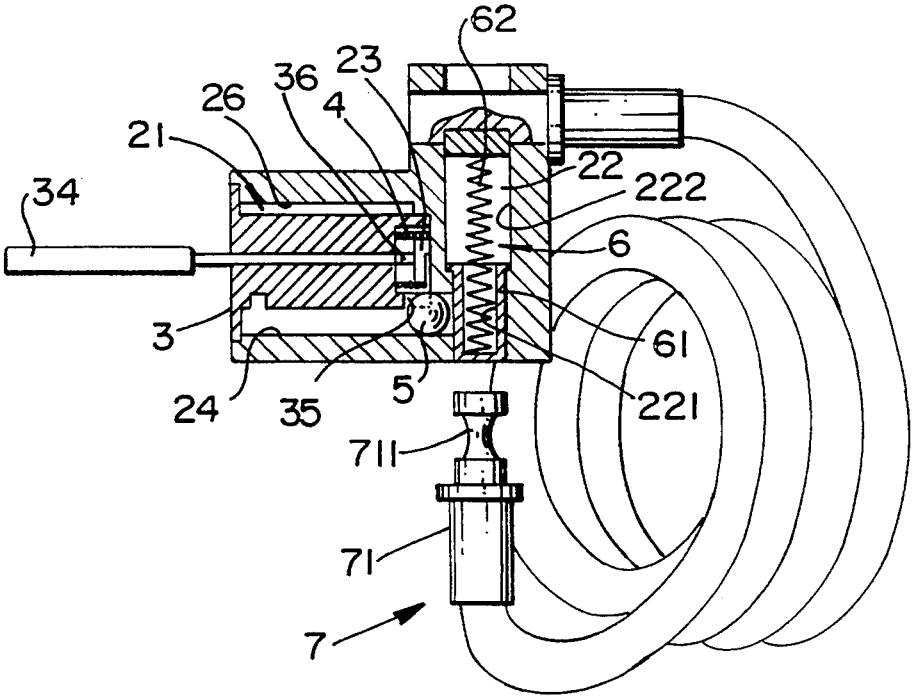
FIG. 8 is a schematic sectional view showing the lock assembly according to the first embodiment of the present invention, wherein the key plug of the lock assembly is in an unlocking position.
Figure 6:
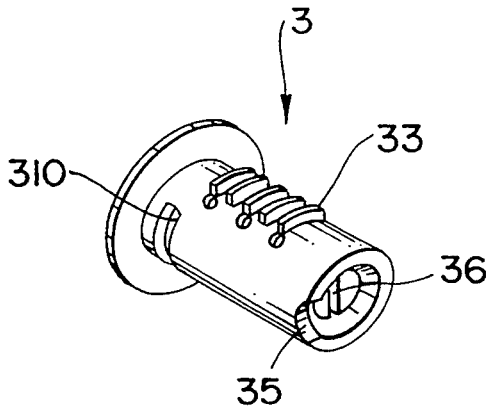
FIG. 6 is a perspective view illustrating the key plug of the 10 lock assembly according to the first embodiment of the present invention.

Referring now to FIGS. 4, 7 and 8, supposing that the key plug 3 is in the locking position after the locking assembly according to the first embodiment of the present invention is assembled, the locking plates 33 extend into the locking groove 26 so as to prevent rotation of the key plug 3. The key 34 is inserted into the keyway so as to retract the locking plates 33 into the plate grooves 31 when it is desired to rotate the key plug 3 from the looking position to the unlocking position. When, the key 34 is turned by the user so as to cause corresponding rotation of the key plug 3, the torsional spring unit 4 is twisted and the ball-receiving notch 35 of the key plug 3 is aligned with the ball-receiving channel 24 of the same such that the compressed biasing means 62 biases the push member 61 outwardly so as to cause corresponding outward movement of the retaining member 71 in order to urge the locking ball 5 to disengage the annular groove 711 of the retaining member 71 and engage the ball-receiving notch 35, thereby ejecting the retaining member 71 from the small diameter portion 221 of the transversely extending hole 22 of the lock shell 2. The pushing member 61 blocks the small diameter portion 221 of the transversely extending hole 22 so as to prevent the locking ball S from extending into the small diameter portion 221 in order to maintain engagement between the locking ball 5 and the ball-receiving notch 35 of the key plug 3, thereby retaining the key plug 3 in the unlocking position.

Figure 9:
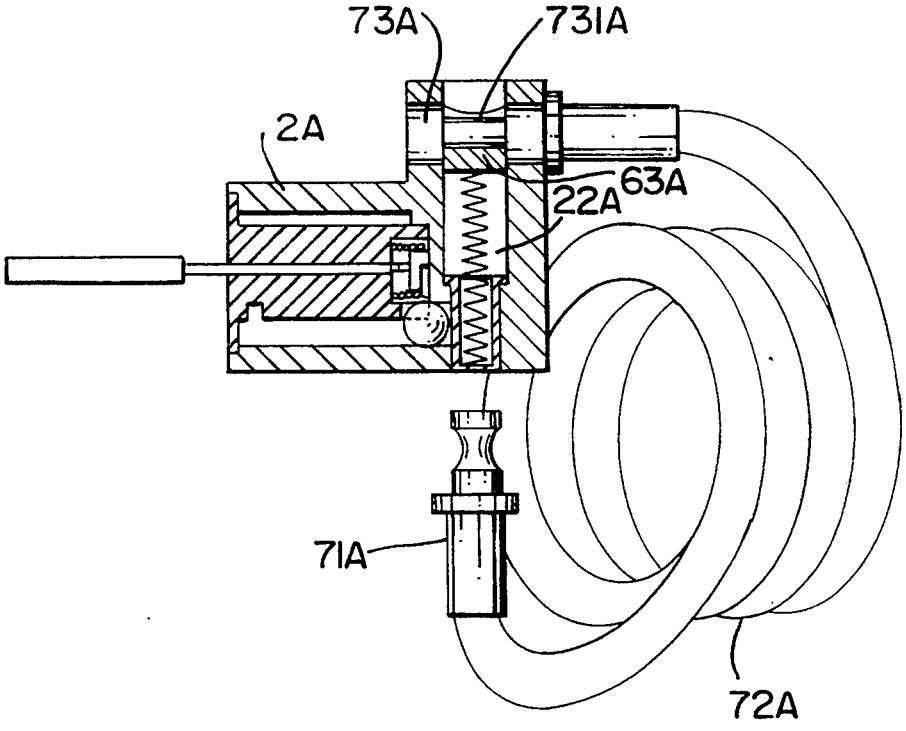
FIG. 9 is a schematic sectional view showing a lock assembly according to a second embodiment of the present invention.

After the locking cable 72 has been wound on a part, such as the frame, of a bicycle (not shown), the retaining member 71 must be inserted into the small diameter portion 221 of the transversely extending hole 22 so as to lock the bicycle part. When the annular groove 711 of the retaining member 71 is aligned with the ball-receiving channel 24, the locking-ball disengages the ball-receiving notch 35 and engages the annular groove 711 of the retaining member 71 due to a returning force of the key plug 3 caused by the twisted torsional spring unit 4. When the locking ball 5 disengages from the ball-receiving notch 35, the key plug 3 is biased to return from the unlocking position to the locking position so as to retain the retaining member 71 in the small diameter portion 221 of the transversely extending hole FIG. 9 shows a second embodiment of the present invention. Unlike to the first embodiment, the engaging member (73A) is a cylindrical rod which has a peripheral surface that is formed with an annular groove (731A) which engages the positioning block (63A).

Accordingly, the lock assembly according to the present invention has the follow advantages:

(1) There is no need to form the lock shell (2,2A) with tumbler-receiving holes for disposing the tumbler segments and the tumbler springs therein. Thus, the construction of the lock shell (2,2A) is simplified in order to result in a shorter production time and in a lower manufacturing cost.

(2) According to the first and second embodiments of the present embodiment, since the connection between the first end of the flexible shackle 7 and the lock shell (2,2A) is achieved by the engagement of a positioning block (63,63A) and an engaging member (73,73A), an additional process for connecting the first end of the flexible shackle and the lock shell is not needed, thereby conveniencing the manufacture of the lock assembly.

(3) The lock assembly of the present invention is convenient to operate due to the following factors: (a) the retaining member (71,71A) of the flexible shackle 7 is pushed to move outward from the small diameter portion 221 of the transversely extending hole (22,22A) when the key plug 3 is rotated from the locking position to the unlocking position; (b) the key plug 3 is retained in the locking position after the retaining member (71,71A) of the shackle 7 has moved outward from the small diameter portion 221 of the transversely extending hole (22,22A); and (c) the key plug 3 is biased to return to the locking position from the unlocking position after the retaining member (71,71A) of the shackle 7 has been inserted into the small diameter portion 221 of the transversely extending hole (22,22A).

(4) In the second embodiment of the present invention, since the engaging member (73A) is a cylindrical rod, the engaging member (73A) can rotate relative to the lock shell (2A), thereby overcoming the problem caused by the resilient twisting force of the locking cable (72A) so as to facilitate the insertion of the retaining member (71A) into the transversely extending hole (22A).

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim

1. A lock assembly, comprising:

a lock shell formed with a longitudinally extending hole, a transversely extending hole adjacent one end of said longitudinally extending hole, and a longitudinal ball-receiving channel which is adjacent to said longitudinally extending hole and which intercommunicates said longitudinally extending hole and said transversely extending hole;

a flexible shackle having a first end portion which is connected to said lock shell and a second end portion which is provided with a retaining member, said retaining member being insertable into said transversely extending hole of said lock shell and having a peripheral surface formed with an annular groove;

a pushing assembly including a push member disposed slidably in said transversely extending hole of said lock shell, and means for biasing said push member to slide outwardly of said transversely extending hole;

a movable locking ball received in said ball-receiving channel; and a key plug received rotatably in said longitudinally extending hole of said lock shell, said key plug having an inner end portion which has a peripheral surface formed with a ball-receiving notch, said key plug being rotatable between a locking position, wherein said retaining member of said shackle is inserted into said transversely extending hole to compress said biasing means and said ball-receiving notch of said key plug is misaligned with said ball-receiving channel so as to permit extension of said locking ball into said transversely extending hole to engage said annular groove of said retaining member in order to retain said retaining member in said transversely extending hole, and an unlocking position, wherein said ball-receiving notch is aligned with said ball-receiving channel and said biasing means biases said push member outwardly so as to cause corresponding outward movement of said retaining member in order to urge said locking ball to disengage said annular groove of said retaining member and engage said ball-receiving notch;

wherein said lock shell is further formed with a receiving space which is located above and communicated with said transversely extending hole, said pushing assembly further including a positioning block which is disposed slidably in said transversely extending hole and which is biased by said biasing means to extend into said receiving space, said first end portion of said flexible shackle being provided with an engaging member which extends into said receiving space and which engages said positioning block in order to retain said engaging member in said receiving space.

2. A lock assembly as claimed in claim 1, further comprising a torsional spring unit disposed in said longitudinally extending hole of said lock shell, said torsional spring having a first end connected to said lock shell and a second end connected to said inner end portion of said key plug.

3. A lock assembly as claimed in claim 1, wherein said engaging member is a cylindrical rod which has a peripheral surface that is formed with an annular groove that engages said positioning block.

4. A lock assembly as claimed in claim 1, wherein said engaging member has a peripheral surface which faces said positioning block and which is formed with an indentation to receive said positioning block therein.

* * * * *